US009997276B2

(12) United States Patent
Yoshida et al.

(10) Patent No.: US 9,997,276 B2
(45) Date of Patent: Jun. 12, 2018

(54) ALUMINUM ALLOY WIRE ROD, ALUMINUM ALLOY STRANDED WIRE, COVERED WIRE, AND WIRE HARNESS, AND METHOD OF MANUFACTURING ALUMINUM ALLOY WIRE ROD

(71) Applicants: FURUKAWA ELECTRIC CO., LTD., Tokyo (JP); FURUKAWA AUTOMOTIVE SYSTEMS INC., Inukami-gun, Shiga (JP)

(72) Inventors: Sho Yoshida, Tokyo (JP); Shigeki Sekiya, Tokyo (JP); Kengo Mitose, Tokyo (JP)

(73) Assignees: FURUKAWA ELECTRIC CO., LTD., Tokyo (JP); FURUKAWA AUTOMOTIVE SYSTEMS INC., Shiga (JP)

( * ) Notice: Subject to any disclaimer, the term of this patent is extended or adjusted under 35 U.S.C. 154(b) by 0 days. days.

(21) Appl. No.: 15/597,546

(22) Filed: May 17, 2017

(65) Prior Publication Data

US 2017/0250003 A1 Aug. 31, 2017

Related U.S. Application Data

(63) Continuation of application No. PCT/JP2015/084195, filed on Dec. 4, 2015.

(30) Foreign Application Priority Data

Dec. 5, 2014 (JP) ..... 2014-247325

(51) Int. Cl.
*H01B 7/00* (2006.01)
*C22F 1/043* (2006.01)
(Continued)

(52) U.S. Cl.
CPC ..... *H01B 7/0045* (2013.01); *B21C 1/02* (2013.01); *B22D 11/003* (2013.01);
(Continued)

(58) Field of Classification Search
CPC ..... H01L 7/0045; H01L 1/023; H01L 5/02; H01L 13/0036; B21C 1/02; B22D 11/003; B22D 11/005; C22C 21/02; C22F 1/043
(Continued)

(56) References Cited

U.S. PATENT DOCUMENTS 9,263,167 B2 2/2016 Yoshida et al.
2013/0264115 A1* 10/2013 Kobayashi ..... H01B 1/023 174/72 A
(Continued)

FOREIGN PATENT DOCUMENTS

CN 101510456 A 8/2009
JP 2004-134212 A 4/2004
(Continued)

OTHER PUBLICATIONS

International Search Report (PCT/ISA/210) issued in PCT/JP2015/084195, dated Mar. 8, 2016.
(Continued)

*Primary Examiner* — Timothy Thompson
*Assistant Examiner* — Charles Pizzuto
(74) *Attorney, Agent, or Firm* — Birch, Stewart, Kolasch & Birch, LLP

(57) ABSTRACT

An aluminum alloy wire rod having a composition comprising Mg: 0.1-1.0 mass %, Si: 0.1-1.2 mass %, Fe: 0.10-1.40 mass %, Ti: 0-0.100 mass %, B: 0-0.030 mass %, Cu: 0-1.00 mass %, Ag: 0-0.50 mass %, Au: 0-0.50 mass %, Mn: 0-1.00 mass %, Cr: 0-1.00 mass %, Zr: 0-0.50 mass %, Hf: 0-0.50 mass %, V: 0-0.50 mass %, Sc: 0-0.50 mass %, Co: 0-0.50 mass %, Ni: 0-0.50 mass %, and the balance: Al and
(Continued)

inevitable impurities, wherein a number of compound particles present on a surface and having a diameter of greater than or equal to 1 μm in terms of equivalent circle diameter is less than or equal to one per 100 $\mu m^2$, and a tensile strength is greater than or equal to 200 MPa.

18 Claims, 1 Drawing Sheet

(51) Int. Cl.

| | |
|---|---|
| ***H01B 13/00*** | (2006.01) |
| ***B21C 1/02*** | (2006.01) |
| ***H01B 1/02*** | (2006.01) |
| ***H01B 5/02*** | (2006.01) |
| ***C22C 21/02*** | (2006.01) |
| ***B22D 11/00*** | (2006.01) |

(52) U.S. Cl.
CPC ..... *B22D 11/005* (2013.01); *C22C 21/02* (2013.01); *C22F 1/043* (2013.01); *H01B 1/023* (2013.01); *H01B 5/02* (2013.01); *H01B 13/0036* (2013.01)

(58) Field of Classification Search
USPC ..... 174/72 A
See application file for complete search history.

(56) References Cited

U.S. PATENT DOCUMENTS

| | | | | |
|---|---|---|---|---|
| 2014/0235116 | A1* | 8/2014 | Otsuka | H01R 4/62 439/877 |
| 2015/0213913 | A1 | 7/2015 | Yoshida et al. | |
| 2015/0213914 | A1 | 7/2015 | Sekiya et al. | |
| 2015/0235729 | A1* | 8/2015 | Yoshida | H01B 1/023 174/74 R |

FOREIGN PATENT DOCUMENTS

| | | | | |
|---|---|---|---|---|
| JP | 2004134212 | A * | 4/2004 | C22C 21/08 |
| JP | 5607853 | B1 | 10/2014 | |
| WO | WO 2012/141041 | A1 | 10/2012 | |
| WO | 2014155818 | A1 | 10/2014 | |
| WO | WO 2014/155820 | A1 | 10/2014 | |

OTHER PUBLICATIONS

Written Opinion (PCT/ISA/237) issued in PCT/JP2015/084195, dated Mar. 8, 2016.
English translation of Written Opinion of the International Searching Authority; International Preliminary Report on Patentability, dated Mar. 8, 2016, issued in PCT/JP2015/084195 (Forms PCT/ISA/237 and PCT/IB/373).
Chinese Office Action and English translation dated Feb. 27, 2018 in corresponding Application No. CN 201580059391.7.

* cited by examiner

ALUMINUM ALLOY WIRE ROD, ALUMINUM ALLOY STRANDED WIRE, COVERED WIRE, AND WIRE HARNESS, AND METHOD OF MANUFACTURING ALUMINUM ALLOY WIRE ROD

CROSS REFERENCE TO RELATED APPLICATIONS

This is a continuation application of International Patent Application No. PCT/JP2015/084195 filed Dec. 4, 2015, which claims the benefit of Japanese Patent Application No. 2014-247325, filed Dec. 5, 2014, the full contents of all of which are hereby incorporated by reference in their entirety.

BACKGROUND

Technical Field

The present disclosure relates to an aluminum alloy wire rod used as a conductor of an electric wiring structure, an aluminum alloy stranded wire, a covered wire and a wire harness and a method of manufacturing an aluminum alloy wire rod.

Background Art

In the related art, a so-called wire harness has been used as an electric wiring structure for transportation vehicles such as automobiles, trains, and aircrafts, or an electric wiring structure for industrial robots. The wire harness is a member including electric wires each having a conductor made of copper or copper alloy and fitted with terminals (connectors) made of copper or copper alloy (e.g., brass). With recent rapid advancements in performances and functions of automobiles, various electrical devices and control devices installed in vehicles tend to increase in number and electric wiring structures used for these devices also tend to increase in number. On the other hand, for environmental friendliness, lightweighting of transportation vehicles is strongly desired for improving fuel efficiency of transportation vehicles such as automobiles.

As one of the measures for achieving lightweighting of transportation vehicles, there have been, for example, continuous efforts in the studies of using aluminum or aluminum alloys as a conductor of an electric wiring structure, which is more lightweight, instead of conventionally used copper or copper alloys. Since aluminum has a specific gravity of about one-third of a specific gravity of copper and has a conductivity of about two-thirds of a conductivity of copper (in a case where pure copper is a standard for 100% IACS, pure aluminum has approximately 66% IACS), an aluminum conductor wire rod needs to have a cross sectional area of approximately 1.5 times greater than that of a copper conductor wire rod to allow the same electric current as the electric current flowing through the copper conductor wire rod to flow through the pure aluminum conductor wire rod. Even an aluminum conductor wire rod having an increased cross section as described above is used, using an aluminum conductor wire rod is advantageous from the viewpoint of lightweighting, since an aluminum conductor wire rod has a mass of about half the mass of a pure copper conductor wire rod. It is to be noted that % IACS represents a conductivity when a resistivity $1.7241\times10^{-8}$ Ωm of International Annealed Copper Standard is taken as 100% IACS.

For example, aluminum alloy wire rods containing Mg and Si are known as high strength aluminum alloy wire rods.

A typical example of this aluminum alloy wire rod is a 6000 series aluminum alloy (Al—Mg—Si based alloy) wire rod. Generally, the strength of the 6000 series aluminum alloy wire rod can be increased by applying a solution treatment and an aging treatment.

In Japanese Patent No. 5607853, which is as document of a patent based on a patent application already filed and patented, the present inventors have proposed an invention relating to, in particular, a 6000-series aluminum alloy wire rod. In Japanese Patent No. 5607853, by controlling precipitated structure through studies on components and processes, it has been made possible to manufacture an aluminum alloy wire rod having a high strength, a high conductivity and a high elongation each being at a satisfactory level even when used as an extra fine wire having a wire size of less than or equal to 0.5 mm.

However, depending on an application of an aluminum alloy wire rod, there are cases where improvement in platability is required, and thus, further technical improvement is required. Examples of a plating to be used for improving platability may include a copper plating to decrease electrical contact resistance in a terminal crimping portion, and a chromium plating and a nickel plating to improve corrosion resistance and wear resistance.

In contrast, in a conventional aluminum alloy wire rod, after plating, surface defects such as pinholes or asperities may occur, or the plating may peel off, and it has been found that generation of such surface defects tends to accelerate a decrease in corrosion resistance, degradation of an exterior appearance, and a decrease in a use-life due to the concentration of stress. Since Japanese Patent No. 5607853 focuses on obtaining an appropriate low yield strength, there is a problem that the tensile strength cannot be sufficiently increased when a strength balance is taken into consideration.

Accordingly, the present disclosure is related to providing an aluminum alloy wire rod used as a conductor of an electric wiring structure, having an improved platability by suppressing the generation of pinholes or asperities on a plated film surface by controlling the particle size and the presence ratio of a compound present on a surface of the wire rod, subsequently a plated film is formed on the surface of the wire rod, an aluminum alloy stranded wire, a covered wire and a wire harness, and a method of manufacturing an aluminum alloy wire rod.

The present inventors have hitherto carried out a continuous research and found that there is such a problem to be solved as described below, and as a result of studies carried out to solve the problem, obtained the following findings.

Specifically, alumina which is a raw material for an aluminum alloy wire rod usually contains a large amount of Fe. For example, a 99.7 mass % aluminum, which is a general aluminum ground metal, contains Fe of 0.2 mass % (see Table 3 in JIS H2102: 2011), at maximum. Fe contained in the aluminum ground metal is bonded to other components such as Al and Si to produce compounds that are lower in conductivity than the aluminum matrix, and thus surface defects such as pinholes or asperities are likely to be generated after plating. Surface defects such as pinholes or asperities cause problems such as a decrease in corrosion resistance, degradation of exterior appearance, a decrease in use-life due to the concentration of stress and peeling of plating. Therefore, in order to solve such problems, the Fe content in the aluminum ground metal is preferably small. On the other hand, when a high purity Al ground metal having a small Fe content is used, the mass productivity is decreased and at the same time, a grain size refinement effect of Fe is not obtained, and consequently the strength of the obtained Al alloy wire rod tends to decrease.

The present inventors have also carried out assiduous studies on 6000-series aluminum alloys, which are precipitation-type Al—Mg—Si alloys capable of obtaining high strengths and high conductivities, and also on 1000, 2000, 3000, 4000, 5000, 7000 and 8000-series aluminum alloys, and reached the findings that the particle size and the presence ratio of compound particles present on the surface of the wire rod surface are correlated with generation of pinholes on a surface of a plated film when forming a plated film on the surface of the wire rod, and have further elucidated an effect of additive components and a manufacturing process on the compound particles present on the surface of the wire rod. Thus, the present inventors have succeeded in manufacturing an aluminum alloy wire rod having good platability and a high strength, and the present disclosure has been completed.

SUMMARY

According to a first aspect of the present disclosure, an aluminum alloy wire rod having a composition consisting of or comprising Mg: 0.1 mass % to 1.0 mass %, Si: 0.1 mass % to 1.2 mass %, Fe: 0.10 mass % to 1.40 mass %, Ti: 0 mass % to 0.100 mass %, B: 0 mass % to 0.030 mass %, Cu: 0 mass % to 1.00 mass %, Ag: 0 mass % to 0.50 mass %, Au: 0 mass % to 0.50 mass %, Mn: 0 mass % to 1.00 mass %, Cr: 0 mass % to 1.00 mass %, Zr: 0 mass % to 0.50 mass %, Hf: 0 mass % to 0.50 mass %, V: 0 mass % to 0.50 mass %, Sc: 0 mass % to 0.50 mass %, Co: 0 mass % to 0.50 mass %, Ni: 0 mass % to 0.50 mass %, and the balance: Al and inevitable impurities, wherein the presence ratio of compound particles, present on the surface of the aluminum alloy wire rod, each having a diameter of greater than or equal to 1 μm in terms of equivalent circle diameter is less than or equal to one particle in 100 $\mu m^2$, and the tensile strength is greater than or equal to 200 MPa. It is to be noted that of the elements given the contents range in the chemical composition, any one of the elements each having a lower limit of the content described as "0 mass %" means a selective additive element to be optionally added if necessary. In other words, in a case where the content of a given additive element is "0 mass %," it means that such an additive element is not included.

According to a second aspect of the present disclosure, a wire harness includes a covered wire including a covering layer at an outer periphery of one of an aluminum alloy wire rod and an aluminum alloy stranded wire; and a terminal fitted at an end portion of the covered wire, the covering layer being removed from the end portion, wherein the aluminum alloy wire rod had a composition comprising Mg: 0.1 mass % to 1.0 mass %, Si: 0.1 mass % to 1.2 mass %, Fe: 0.10 mass % to 1.40 mass %, Ti: 0 mass % to 0.100 mass %, B: 0 mass % to 0.030 mass %, Cu: 0 mass % to 1.00 mass %, Ag: 0 mass % to 0.50 mass %, Au: 0 mass % to 0.50 mass %, Mn: 0 mass % to 1.00 mass %, Cr: 0 mass % to 1.00 mass %, Zr: 0 mass % to 0.50 mass %, Hf: 0 mass % to 0.50 mass %, V: 0 mass % to 0.50 mass %, Sc: 0 mass % to 0.50 mass %, Co: 0 mass % to 0.50 mass %, Ni: 0 mass % to 0.50 mass %, and the balance: Al and inevitable impurities, wherein a number of compound particles present on a surface and having a diameter of greater than or equal to 1 μm in terms of equivalent circle diameter is less than or equal to one per 100 $\mu m^2$, and a tensile strength is greater than or equal to 200 MPa.

According to a third aspect of the present disclosure, a method of manufacturing an aluminum alloy wire rod includes forming a drawing stock through hot working subsequent to melting and casting an aluminum alloy material having a composition comprising Mg: 0.1 mass % to 1.0 mass %, Si: 0.1 mass % to 1.2 mass %, Fe: 0.10 mass % to 1.40 mass %, Ti: 0 mass % to 0.100 mass %, B: 0 mass % to 0.030 mass %, Cu: 0 mass % to 1.00 mass %, Ag: 0 mass % to 0.50 mass %, Au: 0 mass % to 0.50 mass %, Mn: 0 mass % to 1.00 mass %, Cr: 0 mass % to 1.00 mass %, Zr: 0 mass % to 0.50 mass %, Hf: 0 mass % to 0.50 mass %, V: 0 mass % to 0.50 mass %, Sc: 0 mass % to 0.50 mass %, Co: 0 mass % to 0.50 mass %, Ni: 0 mass % to 0.50 mass %, and the balance: Al and inevitable impurities; and subsequently, performing steps including at least a wire drawing step, an solution heat treatment and an aging heat treatment, wherein the solution heat treatment includes heating to a predetermined temperature in range of 450° C. to 580° C., retaining at the predetermined temperature for a predetermined time, and thereafter cooling at an average cooling rate of greater than or equal to 10° C./s to at least a temperature of 150° C.; and the aging heat treatment is performed at a predetermined temperature in a range of 20° C. to 250° C.

It is to be noted that of the elements given the contents range in the chemical composition, any one of the elements each having a lower limit of the content described as "0 mass %" means a selective additive element to be optionally added if necessary. In other words, in a case where the content of a given additive element is "0 mass %," it means that such an additive element is not included.

The aluminum alloy wire rod of the present disclosure has a composition consisting of or comprising Mg: 0.1 mass % to 1.0 mass %, Si: 0.1 mass % to 1.2 mass %, Fe: 0.10 mass % to 1.40 mass %, Ti: 0 mass % to 0.100 mass %, B: 0 mass % to 0.030 mass %, Cu: 0 mass % to 1.00 mass %, Ag: 0 mass % to 0.50 mass %, Au: 0 mass % to 0.50 mass %, Mn: 0 mass % to 1.00 mass %, Cr: 0 mass % to 1.00 mass %, Zr: 0 mass % to 0.50 mass %, Hf: 0 mass % to 0.50 mass %, V: 0 mass % to 0.50 mass %, Sc: 0 mass % to 0.50 mass %, Co: 0 mass % to 0.50 mass %, Ni: 0 mass % to 0.50 mass %, and the balance: Al and inevitable impurities, the presence ratio of compound particles, present on the surface of the aluminum alloy wire rod, each having a diameter of greater than or equal to 1 μm in terms of equivalent circle diameter is less than or equal to one particle in 100 $\mu m^2$. Consequently, it is possible to provide an aluminum alloy wire rod used as a conductor of an electric wiring structure, and having improved platability by suppressing the generation of pinholes or asperities on a surface of a plated film in a case where, subsequently, a plated film is formed on a surface of the wire rod, as well as an aluminum alloy stranded wire, a covered wire and a wire harness, and a method of manufacturing an aluminum alloy wire rod. The aluminum alloy wire rod of the present disclosure has sufficient mechanical characteristics, even when used for a small-diameter wire having a strand diameter of less than or equal to 0.5 mm, in particular, and accordingly the aluminum alloy wire rod is useful as a battery cable, a harness or a conducting wire for a motor equipped on a transportation vehicle, and as a wiring structure of an industrial robot.

DETAILED DESCRIPTION

Figure 1:
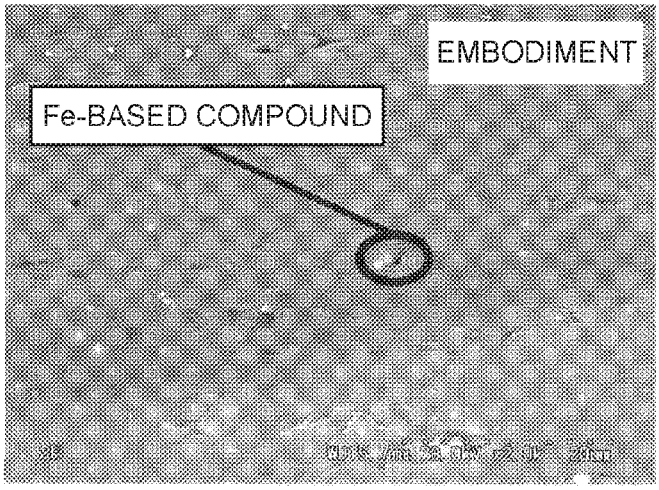
FIG. 1 is a surface SEM photograph of a surface of an aluminum alloy wire rod according to the present disclosure observed with a scanning electron microscope (SEM) at a magnification of 1500×.

Then, the embodiments of the present disclosure will be described. Hereinafter, reasons for limiting the chemical compositions, the surface texture and the like of an aluminum alloy wire rod according to the present disclosure will be described.

(I) Chemical Composition

<Mg: 0.1 Mass % to 1.0 Mass %>

Mg (magnesium) has an effect of strengthening by forming a solid solution in an aluminum matrix, and a part of it has an effect of improving tensile strength by being precipitated as a β"-phase (beta double prime phase) or the like together with Si. In a case where it forms an Mg—Si cluster as a solute atom cluster, it is an element having an effect of improving a tensile strength and an elongation. However, in a case where Mg content is less than 0.10 mass %, the above effects are insufficient. In a case where Mg content is in excess of 1.00 mass %, there is an increased possibility of formation of an Mg-concentration part on a grain boundary, which may cause a decrease in tensile strength and elongation. In addition, due to an increased amount of Mg element forming the solid solution, the 0.2% yield strength is increased, and when a cable is formed by using a wire rod, the ease of routing and handling of an electric wire is decreased and the conductivity is also decreased. Accordingly, the Mg content is 0.1 mass % to 1.0 mass %. The Mg content is, when a high strength is of importance, preferably 0.5 mass % to 1.0 mass %, and when a conductivity is of importance, preferably greater than or equal to 0.1 mass % and less than 0.5 mass %. Based on the points described above, the content of Mg is generally preferably 0.30 mass % to 0.70 mass %.

<Si: 0.1 Mass % to 1.2 Mass %>

Si (silicon) has an effect of strengthening by forming a solid solution in an aluminum matrix, and a part of it has an effect of improving tensile strength and a bending fatigue resistance by being precipitated as a β"-phase (beta double prime phase) or the like together with Mg. Also, in a case where it forms an Mg—Si cluster or a Si—Si cluster as a solute atom cluster, it is an element having an effect of improving a tensile strength and an elongation. However, in a case where Si content is less than 0.1 mass %, the above effects are insufficient. In a case where Si content is in excess of 1.2 mass %, there is an increased possibility of formation of an Si-concentration part on a grain boundary, which may cause a decrease in tensile strength and elongation. Also, due to an increased amount of a solid solution of an Si element, the 0.2% yield strength is increased, the ease of routing and handling is decreased, and the conductivity is also decreased. Accordingly, the Si content is 0.1 mass % to 1.2 mass %. The Si content is, when high strength is of importance, preferably 0.5 mass % to 1.2 mass %, and in case where conductivity is of importance, preferably greater than or equal to 0.1 mass % and less than 0.5 mass %. Based on the points described above, the Si content is generally preferably 0.3 mass % to 0.7 mass %.

<Fe: 0.10 Mass % to 1.40 Mass %>

Fe (iron) is an element that contributes to refinement of crystal grains mainly by forming an Al—Fe based intermetallic compound and provides improved tensile strength. Fe dissolves in Al only by 0.05 mass % at 655° C., and even less at room temperature. Accordingly, the remaining Fe that cannot dissolve in Al will be crystallized or precipitated as an intermetallic compound such as Al—Fe, Al—Fe—Si, and Al—Fe—Si—Mg. The intermetallic compound mainly constituted with Fe and Al as exemplified by the above-described intermetallic compounds is referred to as the Fe-based compound in the present description. This intermetallic compound contributes to the refinement of crystal grains and provides improved tensile strength. Further, Fe has, also by Fe that has dissolved in Al, an effect of providing an improved tensile strength. In a case where Fe content is less than 0.10 mass %, those effects are insufficient. In a case where Fe content is in excess of 1.40 mass %, a wire drawing workability decreases due to coarsening of crystallized materials or precipitates, and also the 0.2% yield strength increases, thus the ease of routing and handling decreases and further the elongation is decreased. Therefore, the Fe content is 0.10 mass % to 1.40 mass %, and preferably 0.15 mass % to 0.70 mass %, and more preferably 0.15 mass % to 0.45 mass %.

The aluminum alloy wire rod of the present disclosure includes Mg, Si and Fe as essential components as described above, and may further contain any one of Ti and B, and at least one of Cu, Ag, Au, Mn, Cr, Zr, Hf, V, Sc, Co and Ni, as necessary.

<Ti: 0.001 Mass % to 0.100 Mass %>

Ti (titanium) is an element having an effect of refining the structure of an ingot during dissolution casting. In a case where an ingot has a coarse structure, the ingot may crack during casting or a wire break may occur during a wire rod processing step, which is industrially undesirable. In a case where the Ti content is less than 0.001 mass %, the aforementioned effect cannot be achieved sufficiently, and in a case where Ti content exceeds 0.100 mass %, the conductivity tends to decrease. Accordingly, the Ti content is 0.001 mass % to 0.100 mass %, preferably 0.005 mass % to 0.050 mass %, and more preferably 0.005 mass % to 0.030 mass %.

<B: 0.001 Mass % to 0.030 Mass %>

Similarly to Ti, B (boron) is an element having an effect of refining the structure of an ingot during dissolution casting. In a case where an ingot has a coarse structure, the ingot may crack during casting or a wire break is likely to occur during a wire rod processing step, which is industrially undesirable. In a case where the B content is less than 0.001 mass %, the aforementioned effect cannot be achieved sufficiently, and in a case where the B content exceeds 0.030 mass %, the conductivity tends to decrease. Accordingly, the B content is 0.001 mass % to 0.030 mass %, preferably 0.001 mass % to 0.020 mass %, and more preferably 0.001 mass % to 0.010 mass %.

To contain at least one of <Cu: 0.01 mass % to 1.00 mass %>, <Ag: 0.01 mass % to 0.50 mass %>, <Au: 0.01 mass % to 0.50 mass %>, <Mn: 0.01 mass % to 1.00 mass %>, <Cr: 0.01 mass % to 1.00 mass %> and <Zr: 0.01 mass % to 0.50 mass %>, <Hf: 0.01 mass % to 0.50 mass %>, <V: 0.01 mass % to 0.50 mass %>, <Sc: 0.01 mass % to 0.50 mass %>, <Co: 0.01 mass % to 0.50 mass %>, and <Ni: 0.01 mass % to 0.50 mass %>

Each of Cu (copper), Ag (silver), Au (gold), Mn (manganese), Cr (chromium), Zr (zirconium), Hf (hafnium), V (vanadium), Sc (scandium), Co (cobalt) and Ni (nickel) is an element having an effect of refining crystal grains and also having an effect of suppressing the production of abnormal coarse grown grains, and Cu, Ag and Au are elements further having an effect of increasing a grain boundary strength by being precipitated at a grain boundary. In a case where at least one of the elements described above is contained by 0.01 mass % or more, the aforementioned effects can be achieved, and a tensile strength and an elongation can be further improved. On the other hand, in a case where any one of Cu, Ag, Au, Mn, Cr, Zr, Hf, V, Sc, Co and Ni has a content exceeding the upper limit thereof mentioned above, a compound containing such elements coarsens and deteriorates wire drawing workability, a wire break is likely to occur and also a conductivity tends to decrease. Therefore, ranges of contents of Cu, Ag, Au, Mn, Cr, Zr, Hf, V, Sc, Co and Ni are the ranges described above, respectively. Among elements in this group of elements, it is particularly preferable to contain Ni. This is because when Ni is contained, a crystal grain refinement effect and an abnormal grain growth suppressant effect become significant, a tensile strength and elongation improve, and also, there is recognized an effect to suppress a decrease in conductivity and a wire break during wire drawing. From the viewpoint of satisfying such effects while ensuring a good balance between these effects, it is further preferable that the Ni content is 0.05 mass % to 0.30 mass %.

As for Fe, Ti, B, Cu, Ag, Au, Mn, Cr, Zr, Hf, V, Sc, Co and Ni, with the increase of the contents of these elements, the conductivity and the elongation tend to decrease, the wire drawing workability tends to be degraded, and the increase of the 0.2% yield strength tends to degrade the ease of routing and handling. Therefore, it is preferable that a sum of the contents of the elements is less than or equal to 2.00 mass %. Since in the aluminum alloy wire rod of the present disclosure, Fe is an essential element, the sum of the contents of Fe, Ti, B, Cu, Ag, Au, Mn, Cr, Zr, Hf, V, Sc, Co and Ni is preferably 0.10 mass % to 2.00 mass %. In a case where the above elements are added alone, the compound containing the element tends to coarsen more as the content increases. Since this may degrade wire drawing workability and a wire break is likely to occur, the content ranges of the respective elements are as specified above.

In order to moderately decrease the yield strength value, while maintaining a high conductivity, the sum of the contents of Fe, Ti, B, Cu, Ag, Au, Mn, Cr, Zr, Hf, V, Sc, Co and Ni is particularly preferably 0.10 mass % to 0.80 mass %, and further preferably 0.15 mass % to 0.60 mass %. On the other hand, although the conductivity is slightly decreased, in order to further appropriately decrease the tensile strength, the elongation and the yield strength value in relation to the tensile strength, the aforementioned content sum is particularly preferably greater than 0.80 mass % and less than or equal to 2.00 mass %, and further preferably 1.00 mass % to 2.00 mass %.

<Balance: Al and Inevitable Impurities>

The balance, i.e., components other than those described above, includes Al (aluminum) and inevitable impurities. Herein, inevitable impurities mean impurities contained by an amount which could be contained inevitably during the manufacturing process. Since inevitable impurities could cause a decrease in conductivity depending on a content thereof, it is preferable to suppress the content of the inevitable impurities to some extent considering the decrease in the conductivity. Components that may be inevitable impurities include, for example, Ga (gallium), Zn (zinc), Bi (bismuth), and Pb (lead).

(II) Surface Texture and Strength Characteristic of Aluminum Alloy Wire Rod

The present disclosure is based on the premise that the chemical composition is limited, and requires a number of compound particles present on a surface and having a diameter of greater than or equal to 1 μm in terms of equivalent circle diameter is less than or equal to one particle per 100 $\mu m^2$, and a tensile strength is greater than or equal to 200 MPa.

The present inventors have carried out assiduous studies as to whether or not the particle size and the presence ratio of the compound present on the surface of the wire rod are correlated with generation of pinholes on a surface of a plated film when forming a plated film on the surface of the wire rod.

Consequently, it has been found that when a number of compound particles having a diameter of greater than or equal to 1 μm in terms of equivalent circle diameter present on the surface of the wire rod is greater than one per 100 $\mu m^2$, defects such as pinholes or asperities tend to occur after plating, and accelerate the decrease of a corrosion resistance, degradation of an exterior appearance, and a decrease in a use-life due to the concentration of stress. Herein, "a diameter in terms of equivalent circle diameter" means a diameter of a perfect circle having the same area as the actual area of a target compound particle.

Figure 2:
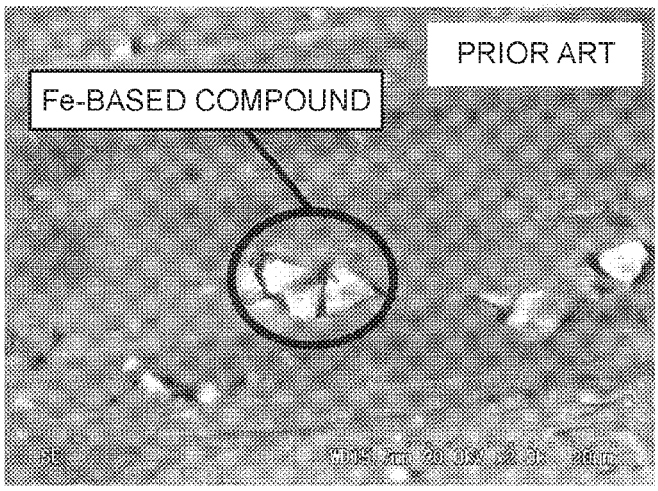
FIG. 2 is a surface SEM photograph of a surface of a conventional aluminum alloy wire rod was observed with a scanning electron microscope (SEM) at a magnification of 1500×.

FIG. 1 shows a typical exemplary surface SEM photograph obtained when a surface of an aluminum alloy wire rod (product of the present disclosure) of an embodiment according to the present disclosure was observed by using a scanning electron microscope (SEM) at a magnification of 1500×, and FIG. 2 is a surface SEM photograph obtained when a surface of a conventional aluminum alloy wire rod (conventional product) was observed under the same conditions as in FIG. 1. As can be seen from FIG. 1 and FIG. 2, the number of the compound particles having a diameter of greater than or equal to 1 μm present on the surface of the aluminum alloy wire rod is extremely small as compared to the conventional product.

As the compound particles present on the surface of an aluminum alloy wire rod, various compounds are possible, and examples of such compounds include mainly a Fe-based compound, and for example, an Al—Fe-based compound, an Al—Fe—Si-based compound, an Al—Fe—Si—Mg-based compound and an Al—Fe—Mn—Si-based compound.

The tensile strength of an aluminum alloy wire rod is required to be greater than or equal to 200 MPa. This is because when the tensile strength of an aluminum alloy wire rod is less than 200 MPa, when disposed as a wire harness in a transportation vehicle, such as an automobile, at a portion where a large tensile force is acting, a wire break might occur, and thus a usage portion will be limited. Accordingly, the tensile strength of the aluminum alloy wire rod was 200 MPa.

Further, the thickness of the surface oxide layer of the wire rod surface is preferably less than or equal to 500 nm. This is because when the thickness is greater than 500 nm, a pretreatment step of plating for removing an oxide film requires a long time, and productivity might largely decrease.

According to the aluminum alloy wire rod of the present disclosure, in a case where a plated film is formed on a surface of the wire rod, the number of pinholes present on a surface of the plated film surface and having a diameter of greater than or equal to 1 μm in terms of equivalent circle diameter can be made to be less than or equal to one pinhole/$mm^2$, and it is also possible to suppress the decrease in corrosion resistance, the degradation of an exterior appearance and a decrease in a use-life due to the concentration of stress.

Such an aluminum alloy wire rod can be obtained by combining and controlling the alloy composition and the manufacturing process. Hereinafter, a description is made of a preferred method of manufacturing an aluminum alloy wire rod of the present disclosure.

(Method of Manufacturing an Aluminum Alloy Wire Rod According to an Example of the Present Disclosure)

The aluminum alloy wire rod according to an Example of the present disclosure can be manufactured by a manufacturing method including forming a drawing stock through hot working subsequent to melting and casting an aluminum alloy material having a composition consisting of or comprising Mg: 0.1 mass % to 1.0 mass %, Si: 0.1 mass % to 1.2 mass %, Fe: 0.10 mass % to 1.40 mass %, Ti: 0 mass % to 0.100 mass %, B: 0 mass % to 0.030 mass %, Cu: 0 mass % to 1.00 mass %, Ag: 0 mass % to 0.50 mass %, Au: 0 mass % to 0.50 mass %, Mn: 0 mass % to 1.00 mass %, Cr: 0 mass % to 1.00 mass %, Zr: 0 mass % to 0.50 mass %, Hf: 0 mass % to 0.50 mass %, V: 0 mass % to 0.50 mass %, Sc: 0 mass % to 0.50 mass %, Co: 0 mass % to 0.50 mass %, Ni: 0 mass % to 0.50 mass %, and the balance: Al and inevitable impurities; the manufacturing method being based on the premise that subsequently, steps including at least a wire drawing step, a solution heat treatment step and an aging heat treatment step are performed; wherein the solution heat treatment is performed by heating to a predetermined temperature in a range of 450° C. to 580° C., holding for a predetermined time, and subsequently cooling at an average cooling rate of greater than or equal to 10° C./s at least to a temperature of 150° C.; and the aging heat treatment is performed by heating to a predetermined temperature in a range of 20° C. to 250° C.

Specific examples of the method of manufacturing an aluminum alloy wire rod of the present disclosure include a manufacturing method including sequentially performing each step of [1] melting, [2] casting, [3] hot working (such as grooved roll working), [4] first wire drawing, [5] first heat treatment (intermediate heat treatment), [6] second wire drawing, [7] second heat treatment (solution heat treatment), and [8] third heat treatment (aging heat treatment). It is to be noted that a stranding step or a wire resin-covering step may be provided before or after the second heat treatment or after the aging heat treatment. Hereinafter, steps of [1] to [8] will be described.

[1] Melting Step

In the melting, a material is prepared by adjusting quantities of each component such that the aforementioned aluminum alloy composition is obtained, and the material is melted.

[2] Casting and [3] Hot Working (Such as Grooved Roll Working)

Subsequently, in the casting step, it is required to increase the cooling rate to reduce and refine crystallization of the compound particles, in particular Fe-based compound particles. From this viewpoint, in the present disclosure, the cooling rate, during casting, in a temperature range from 750° C. to 400° C., is greater than or equal to 20° C./s, additionally a re-heat treatment is performed after the casting and before the hot working, and in the re-heat treatment, heating is performed at a predetermined temperature higher than or equal to 400° C., and a period of time in which the temperature is retained at the predetermined temperature is preferably less than or equal to 10 minutes. Herein, the cooling rate in a temperature range from 750° C. to 400° C. is greater than or equal to 20° C./s in order that the period of time in which the temperature is retained in the Fe crystallization temperature region and the Fe-based compound precipitation temperature region be reduced and the production of the Fe-based compound be suppressed. Also, in the re-heat treatment performed after casting and before hot working, the period of time in which the temperature is retained at the predetermined temperature higher than or equal to 400° C. is less than or equal to 10 minutes, firstly in order that the production of the Fe-based compound be suppressed by reducing the period of time in which the temperature is retained in the precipitation temperature region of the Fe-based compound, and secondly, because a thickness of a surface oxide layer composed of an Al oxide or a Mg oxide can be made to be less than or equal to 500 nm.

It is to be noted that a method of setting an average cooling rate in the temperature range from 750° C. to 400° C. during casting to be greater than or equal to 20° C./s is not particularly limited, but examples of such a method include: a method using a Properzi-type continuous casting rolling mill which is an assembly of a casting wheel and a belt, and a so-called an in-water spinning method, namely, a method in which a molten metal flow is jetted approximately in parallel at the same velocity from an inner side of a rotating drum containing water, and the molten metal is cooled and solidified in the water. In a method using a continuous casting rolling mill, a bar of a diameter of 5 mm to 13 mm can be obtained at an average cooling rate of greater than or equal to 20° C./sec, and by using the in-water spinning method, a bar having a diameter of 1 mm to 13 mm can be obtained at an average cooling rate of greater than or equal to 30° C./sec. Casting and hot rolling may be performed by billet casting and an extrusion technique.

[4] First Wire Drawing

Subsequently, the surface is stripped, if necessary and the bar is made into an appropriate size of, for example, 5 mmφ to 12.5 mmφ, and wire drawing is performed by cold rolling. A reduction ratio η is preferably within a range of 1 to 6. Herein, the reduction ratio η is represented by $\eta=\ln(A_0/A_1)$, where $A_0$ is a wire rod cross sectional area before wire drawing and $A_1$ is a wire rod cross sectional area after wire drawing. In a case where the reduction ratio η is less than 1, in a heat treatment of a subsequent step, recrystallized grains coarsen and a tensile strength and an elongation significantly decrease, which may cause a wire break. In a case where the reduction ratio η is greater than 6, the wire drawing becomes difficult and may be problematic from a quality point of view since a wire break might occur during a wire drawing process. The stripping of the surface has an effect of cleaning the surface, but does not need to be performed.

[5] First Heat Treatment (Intermediate Heat Treatment)

Then, a first heat treatment is applied to the work piece that has been subjected to cold drawing. The first heat treatment of the present disclosure is performed for regaining the flexibility of the work piece and for improving the wire drawing workability. It is not necessary to perform the first heat treatment if the wire drawing workability is sufficient and a wire break will not occur. In order to prevent the coarsening of the intermetallic compound and to suppress the growth of the surface oxide layer, the first heat treatment is preferably performed at 400° C. or lower, and the period of time of being exposed to a temperature higher than 400° C. is preferably less than 10 minutes.

[6] Second Wire Drawing

After the first heat treatment, wire drawing is further carried out in a cold processing. During this drawing, a reduction ratio η is preferably within a range of 1 to 6. The reduction ratio η has an influence on formation and growth of recrystallized grains. This is because, if the reduction ratio η is less than 1, during the heat treatment in a subsequent step, there is a tendency such that coarsening of recrystallized grains occur and the tensile strength and the elongation drastically decrease, and if the reduction ratio η is greater than 6, wire drawing becomes difficult and there is a tendency such that problems arise in quality, such as a wire break during wire drawing. It is to be noted that in a case where the first heat treatment is not performed, the first wire drawing and the second wire drawing may be performed in series.

[7] Second Heat Treatment (Solution Heat Treatment)

The second heat treatment is performed on the work piece that has been subjected to wire drawing. The second heat treatment of the present disclosure is a solution heat treatment for dissolving randomly contained compounds of Mg and Si into an aluminum matrix. With the solution treatment, it is possible to even out the Mg and Si concentration parts during a working (it homogenizes) and leads to a suppression in the segregation of a Mg compound and a Si compound at grain boundaries after the final aging heat treatment. The second heat treatment is specifically a heat treatment including heating to a predetermined temperature in a range of 450° C. to 580° C., retaining at the predetermined temperature for a predetermined time, and thereafter cooling at an average cooling rate of greater than or equal to 10° C./s to at least a temperature of 150° C. When a predetermined temperature during the second heat treatment is higher than 580° C., the crystal grain size is coarsened and abnormally grown grains are produced, and in a case where the predetermined temperature is lower than 450° C., $Mg_2Si$ cannot be sufficiently solid dissolved. Therefore, the predetermined temperature during the heating in the second heat treatment is in a range of 450° C. to 580° C., and although the predetermined temperature may vary depending on the contents of Mg and Si, the predetermined temperature is preferably in a range of 450° C. to 540° C., and more preferably in a range of 480° C. to 520° C. The sum of the periods of time for retaining the wire rod at 400° C. or higher in the re-heat treatment and the first heat treatment (the intermediate heat treatment) after casting is preferably set to fall within a range of less than or equal to 10 minutes. When the average cooling rate at least to a temperature of 150° C. is slower than 10° C./s, Mg and Si are once solid-dissolved in the aluminum matrix and tend to be easily precipitated again as a compound of Mg and Si. Accordingly, in the present disclosure, the solution heat treatment is performed by heating to a predetermined temperature within a range of 450° C. to 580° C., retaining at the predetermined temperature for a predetermined time, and thereafter cooling at an average cooling rate of greater than or equal to 10° C./s at least to the temperature of 150° C.

A method of performing the second heat treatment may be, for example, batch heat treatment, salt bath, or may be continuous heat treatment such as high-frequency heating, conduction heating, and running heating.

In a case where high-frequency heating and conduction heating are used, the wire rod temperature increases with a passage of time, since it normally has a structure in which an electric current continues to flow through the wire rod. Accordingly, since the wire rod may melt when an electric current continues to flow through, it is necessary to perform heat treatment for an appropriate time range. In a case where running heating is used, since it is an annealing in a short time, the temperature of a running annealing furnace is usually set higher than a wire rod temperature. Since the wire rod may melt with a heat treatment over a long time, it is necessary to perform heat treatment in an appropriate time range. The heating retention times in all the heat treatments are each required to be longer than or equal to a predetermined time in order to dissolve compounds of Mg and Si randomly contained in a work piece into an aluminum matrix. Hereinafter, the heat treatment by each method will be described.

The continuous heat treatment by high-frequency heating is a heat treatment by joule heat generated from the wire rod itself by an induced current by the wire rod continuously passing through a magnetic field caused by a high frequency. Steps of rapid heating and quenching are included, and the wire rod can be heat-treated by controlling the wire rod temperature and the heat treatment time. The cooling is performed after rapid heating by continuously allowing the wire rod to pass through water or in a nitrogen gas atmosphere. The heating treatment time is 0.01 s to 2 s, preferably 0.05 s to 1 s, and more preferably 0.05 s to 0.5 s.

The continuous conducting heat treatment is a heat treatment by joule heat generated from the wire rod itself by allowing an electric current to flow in the wire rod that continuously passes two electrode wheels. Steps of rapid heating and quenching are included, and the wire rod can be heat-treated by controlling the wire rod temperature and the heat treatment time. The cooling is performed after rapid heating by continuously allowing the wire rod to pass through water, atmosphere or a nitrogen gas atmosphere. The heating treatment time is 0.01 s to 2 s, preferably 0.05 s to 1 s, and more preferably 0.05 s to 0.5 s.

A continuous running heat treatment is a heat treatment in which the wire rod continuously passes through a heat treatment furnace retained at a high-temperature. Steps of rapid heating and quenching are included, and the wire rod can be heat-treated by controlling the temperature in the heat treatment furnace and the heat treatment time. The cooling is performed after rapid heating by continuously allowing the wire rod to pass through water, atmosphere or a nitrogen gas atmosphere. The heating treatment time is preferably 0.5 s to 30 s.

In a case where at least one of the wire rod temperature or the heat treatment time is lower than the condition defined above, the solution heat treatment will be incomplete, and solute atom clusters, a β"phase and a $Mg_2Si$ precipitate produced during the aging heat treatment, which is a post-process, are reduced, and the improvement magnitudes of the tensile strength, the shock resistance, the bending fatigue resistance and the conductivity are decreased. In a case where at least one of the wire rod temperature or the annealing time is higher than the condition specified above, the crystal grains coarsen and a partial fusion (eutectic fusion) of a compound phase of an aluminum alloy wire rod occurs, and the tensile strength and the elongation decrease, and a wire break is likely to occur during the handling of the conductor.

[8] Third Heat Treatment (Aging Heat Treatment)

Subsequently, a third heat treatment is applied. The third heat treatment is an aging heat treatment performed for producing Mg and Si compounds and solute atom clusters. In the present disclosure, the heating temperature of the aging heat treatment is 20° C. to 250° C. In a case where the heating temperature in the aging heating treatment is lower than 20° C., the production of the solute atom clusters is slow and requires time to obtain necessary tensile strength and elongation, and thus it is disadvantageous for mass-production. In a case where the heating temperature is higher than 250° C., in addition to the $Mg_2Si$ needle-like precipitate (β" phase) most contributing to the strength, coarse $Mg_2Si$ precipitates are produced to decrease the strength. Accordingly, in the present disclosure, the heating temperature of the aging heat treatment is 20° C. to 250° C. In a case where it is necessary to produce solute atom clusters that are more effective in improving the elongation, the heating temperature in the aging heat treatment is preferably 20° C. to 70° C., and in a case where the β" phase is simultaneously precipitated, and the balance between the tensile strength and the elongation is required to be achieved, the heating temperature in the aging heat treatment is preferably 100° C. to 150° C.

Moreover, as for the heating retention time in the aging heat treatment, the optimal time is varied depending on the temperature. Moreover, for the purpose of improving the tensile strength and the elongation, and reducing the 0.2% yield strength in relation to the tensile strength, the heating time is preferably long when the temperature is low and the heating time is preferably short when the temperature is high. For example, a long heating time is ten days or less, and, a short heating time is, preferably, 15 hours or less, and more preferably, 8 hours or less. It is to be noted that, in order to prevent dispersion of the properties, it is preferable to increase the cooling rate as much as possible in the cooling in the aging heat treatment. Of course, even in a case where cooling cannot be performed quickly due to the manufacturing process, the cooling rate can be appropriately set if the cooling time is an aging condition with which solute atom clusters are produced sufficiently.

A strand diameter of the aluminum alloy wire rod of the present embodiment is not particularly limited and can be determined appropriately according to the purpose of use, and is preferably 0.1 mm to 0.5 mmφ for a fine wire, and 0.8 mm to 1.5 mmφ for a middle sized wire. The aluminum alloy wire rod of the present embodiment is advantageous in that the aluminum alloy wire can be used as a thin single wire as an aluminum alloy wire, but may also be used as an aluminum alloy stranded wire obtained by stranding a plurality of them together, and among the aforementioned steps [1] to [8] of the manufacturing method of the present disclosure, after bundling and stranding a plurality of aluminum alloy wire rods obtained by sequentially performing the respective steps [1] to [6], the steps of [7] the second heat treatment (the solution heat treatment) and [8] the third heat treatment (the aging heat treatment) may also be performed.

Also, in the present embodiment, such a homogenizing heat treatment as performed in the prior art may be further performed as an additional step after continuous casting rolling. Since the homogenizing heat treatment can uniformly disperse the added elements, a crystallized material, a solute atom cluster and the β" precipitation phase are easily produced uniformly in the subsequent third heat treatment, and the improvement of the tensile strength, the improvement of the elongation, and the improvement of the yield strength in relation to the tensile strength are obtained more stably. The homogenizing heat treatment is performed at a heating temperature of preferably 450° C. to 600° C. and more preferably 500° C. to 600° C. Also, the cooling in the homogenizing heat treatment is preferably a slow cooling at an average cooling rate of 0.1° C./min to 10° C./min because of the easiness in obtaining a uniform compound.

Also, the aluminum alloy wire rod of the present embodiment can be used as an aluminum alloy wire, or as an aluminum alloy stranded wire obtained by stranding a plurality of aluminum alloy wires, and may also be used as a covered wire having a covering layer at an outer periphery of the aluminum alloy wire or the aluminum alloy stranded wire, and, in addition, the aluminum alloy wire rod can also be used as a wire harness having a covered wire and a terminal fitted at an end portion of the covered wire, the covering layer being removed from the end portion.

EXAMPLES

The present disclosure will be described in detail on the basis of the following examples. It is to be noted that the present disclosure is not limited to the examples described below.

Examples and Comparative Examples

Mg, Si, Fe, and Al, and selectively added Ti, B, Cu, Ag, Au, Mn, Cr, Zr, Hf, V, Sc, Co and Ni were placed in a Properzi-type continuous casting rolling mill such that the contents (mass %) were as shown in Table 1, and a molten metal containing these raw materials was continuously rolled while being cast with a water-cooled mold in the Properzi-type continuous casting rolling mill under the conditions shown in Table 2, and thus a bar of φ9 mm was obtained. Then, the first wire drawing was applied to the bar so as to obtain a predetermined reduction ratio. Then, the first heat treatment (the intermediate heat treatment) was applied to a work piece subjected to the first wire drawing under the conditions shown in Table 2, and thereafter, further a second wire drawing was applied to the work piece subjected to the first heat treatment until a wire size of φ0.3 mm was achieved so as to obtain a predetermined reduction ratio. Then, the second heat treatment (the solution heat treatment) was applied under the conditions shown in Table 2. Both in the first heat treatment and in the second heat treatment, in a case of a batch heat treatment, the wire rod temperature was measured with a thermocouple wound around the wire rod. In the continuous conducting heat treatment, since the measurement at a part where the temperature of the wire rod was the highest was difficult due to equipment, the temperature was measured with a fiber optic radiation thermometer (manufactured by Japan Sensor Corporation) at a position upstream of a portion where the temperature of the wire rod was highest, and the maximum temperature was calculated in consideration of joule heat and heat dissipation. In each of the high-frequency heating and the consecutive running heat treatment, the wire rod temperature in the vicinity of the heat treatment section outlet was measured. After the second heat treatment, the third heat treatment (the aging heat treatment) was applied under the conditions shown in Table 1, and aluminum alloy wires were produced.

For each of the produced aluminum alloy wires of Examples and Comparative Examples, the respective characteristics were measured by the methods shown below. The results thus obtained are shown in Table 3. Physical properties were also measured when various platings were further applied to the surface of the respective produced aluminum alloy wires, and the results thus obtained are also shown in Table 3.

[Evaluation Methods]

(A) Measurements of Particle Sizes and Presence Ratio of Compound Particles Present on Wire Rod Surface By using a scanning electron microscope (SEM), the particle size and the presence ratio of the compound particles present on the wire rod surface, specifically, the presence ratio of the particles present on the wire rod surface and having a diameter of greater than or equal to 1 μm in terms of equivalent circle diameter is measured by the following technique. A first spot is a region of 1000 $\mu m^2$ observed at an arbitrary position on a surface of the wire rod. A second spot is a region of 1000 $\mu m^2$ observed at a position on the surface of the wire rod spaced apart from the first spot by 1000 mm or more in a lengthwise direction of the wire rod. A third spot is a region of 1000 $\mu m^2$ observed at a position on the surface of the wire rod spaced apart from the first spot by 2000 mm or more in the lengthwise direction of the wire rod and spaced apart from the second spot by 1000 mm or more in the lengthwise direction of the wire rod, and, the presence ratio (particle(s)/100 $\mu m^2$) of the compound particles present on the surface of the wire rod and having a diameter of greater than or equal to 1 μm in terms of equivalent circle diameter is calculated. It is to be noted that the aforementioned diameter was obtained by binarizing an obtained SEM image and obtaining an area of a compound particle, and by converting the same area into an equivalent circle diameter.

(B) Measurement of Thickness of Surface Oxide Layer of Wire Rod

A thickness of the surface oxide layer of the wire rod is measured by using an Auger electron spectrometer. An average value calculated from the measurement values at three spots in total is taken as a thickness of the surface oxide layer of the wire rod. The measurements are performed by spacing apart the first spot and the second spot by 1000 mm or more in the lengthwise direction of the wire rod, spacing apart the first spot and the third spot by 2000 mm or more in the lengthwise direction of the wire rod, and spacing apart the second spot and the third spot by 1000 mm or more in the lengthwise direction of the wire rod.

(C) Measurements of Tensile Strength and Elongation after Fracture

In conformity with JIS Z 2241: 2011, a tensile test was carried out for each of three materials under test (aluminum alloy wires), and the average values of the tensile strength and the elongation after fracture were obtained. The tensile strength of greater than or equal to 200 MPa was regarded as a pass level so as to keep the tensile strength of a crimp portion at a connection portion between an electric wire and a terminal and to withstand a load abruptly applied during an installation work to a car body.

(D) Conductivity

In a constant temperature bath in which a test piece of 300 mm in length is held at 20° C. (±0.5° C.), a resistivity was measured for three materials under test (aluminum alloy wires) each time using a four terminal method, and an average conductivity was calculated. The distance between the terminals was 200 mm. The conductivity of greater than or equal to 45% IACS was regarded as an acceptable level.

(E) Measurement of Presence Ratio of Pinholes Present on Surface after Plating

By using a scanning electron microscope (SEM), the diameter and the presence ratio of the pinholes present on the surface of the wire rod, specifically the presence ratio of the pinholes present on the surface of the wire rod and having a diameter of greater than or equal to 1 μm in terms of equivalent circle diameter are measured by the following technique. A first spot is a region of 1000 $\mu m^2$ observed at an arbitrary position on the surface of the wire rod. A second spot is a region of 1000 $\mu m^2$ observed at a position spaced apart from the first spot by 1000 mm or more in the lengthwise direction of the wire rod. A third spot is a region of 1000 $\mu m^2$ observed at a position of the wire rod spaced apart from the first spot by 2000 mm or more in the lengthwise direction of the wire rod and spaced apart the second spot by 1000 mm or more in the lengthwise direction of the wire rod, and a presence ratio (pinhole(s)/100 $\mu m^2$) of the pinholes present on the surface of the wire rod and each having a diameter of greater than or equal to 1 μm in terms of equivalent circle diameter is calculated.

(F) Evaluation of Platability

The neutral salt spray test described in JIS Z 2371: 2015 was performed for 96 hours, and the results were classified into two grades on the basis of an exterior appearance after the test. A case where substantially no degradation was found was marked with "○" and the case where degradation was found was marked with "X".

(G) Comprehensive Evaluation

The comprehensive evaluations shown in Table 3 are indicated by four grades "A" to "D," according to the standards shown in Table 4 presented below, and "A," "B" and "C" were each regarded as a pass level, and "D" was regarded as rejectable.

TABLE 1

| | | Chemical Composition (mass %) | | | | | | | | | | | | | | | | |
|---|---|---|---|---|---|---|---|---|---|---|---|---|---|---|---|---|---|---|
| | No. | Mg | Si | Fe | Ti | B | Cu | Ag | Au | Mn | Cr | Zr | Hf | V | Sc | Co | Ni | Al |
| Example | 1 | 0.4 | 0.7 | 0.10 | 0.01 | 0.005 | — | — | — | 0.05 | — | — | — | — | — | — | — | Balance |
| | 2 | 0.4 | 0.7 | 0.10 | 0.01 | 0.005 | — | — | — | — | — | 0.05 | — | — | — | — | — | |
| | 3 | 0.4 | 0.7 | 0.20 | 0.01 | 0.005 | — | — | — | — | — | — | — | — | — | — | 0.05 | |
| | 4 | 0.4 | 0.7 | 0.20 | 0.01 | 0.005 | — | — | — | 0.05 | — | — | — | — | — | — | — | |
| | 5 | 0.4 | 0.7 | 0.30 | 0.01 | 0.005 | — | — | — | 0.05 | — | — | — | — | — | — | — | |
| | 6 | 0.4 | 0.7 | 0.30 | 0.01 | 0.005 | — | — | — | 0.10 | 0.10 | — | — | — | 0.10 | 0.05 | — | |
| Comparative | 1 | 0.4 | 0.7 | ***1.50*** | 0.01 | 0.005 | — | — | — | 0.05 | — | — | — | — | — | — | — | Balance |
| Example | 2 | 0.4 | 0.7 | ***0.01*** | 0.01 | 0.005 | — | — | — | — | 0.05 | — | — | — | — | — | — | |
| | 3 | 0.4 | 0.7 | 0.20 | 0.01 | 0.005 | 0.05 | — | — | — | — | — | — | — | — | — | — | |
| | 4 | 0.4 | 0.7 | 0.10 | 0.01 | 0.005 | — | — | — | — | — | 0.05 | — | — | — | — | — | |
| | 5 | 0.4 | 0.7 | 0.10 | 0.01 | 0.005 | — | — | — | — | — | 0.05 | — | — | — | — | — | |

N.B. Numerical values in bold italic in the table are out of appropriate range of the present invention.

TABLE 2

| | | Casting conditions | | | Solution heat treatment conditions | | | | |
|---|---|---|---|---|---|---|---|---|---|
| | | Average cooling rate from 750° C. | Re-heat treatment conditions | | | | Average cooling rate at least to a temperature | Aging heat treatment conditions | |
| | No. | to 400 C° (° C./s) | Temp. (° C.) | Time (s) | Temp. (° C.) | Retention time (s) | of 150° C. (° C./s) | Temp. (° C.) | Retention time (h) |
| Example | 1 | 25 | 550 | 10 | 500 | 30 | 15 | 150 | 5 |
| | 2 | 25 | 550 | 10 | 500 | 60 | 17 | 150 | 5 |
| | 3 | 25 | 550 | 10 | 500 | 120 | 15 | 150 | 5 |
| | 4 | 25 | 550 | 5 | 540 | 10 | 20 | 150 | 5 |
| | 5 | 25 | 550 | 10 | 540 | 60 | 21 | 150 | 5 |
| | 6 | 25 | 550 | 10 | 540 | 120 | 22 | 150 | 5 |
| Comparative Example | 1 | 25 | 550 | 10 | 500 | 30 | 19 | 150 | 5 |
| | 2 | 25 | 550 | 10 | 540 | 10 | 18 | 150 | 5 |
| | 3 | 25 | 550 | 3600 | 540 | 3600 | 18 | 150 | 5 |
| | 4 | 25 | 550 | 10 | ***620*** | 60 | 20 | 150 | 5 |
| | 5 | 25 | 550 | 10 | 500 | 60 | 21 | ***350*** | 5 |

N.B. Numerical values in bold italic in the table are out of appropriate range of the present invention.

TABLE 3

| | | Al alloy wire rod | | | | | Plated Al Alloy wire rod | | | |
|---|---|---|---|---|---|---|---|---|---|---|
| | | Presence ratio of compound particles greater than or equal to 1 μm present on | Thickness | Characteristics | | | | Characteristics | | |
| | No. | surface (particle(s)/100 μm$^2$) | of surface oxide layer (nm) | Tensile strength (MPa) | Elongation after fracture (%) | Conductivity (% IACS) | Type of plating | Presence ratio of pinholes on plating surface (pinhole(s)/mm$^2$) | Evaluation of platability | Evaluation |
| Example | 1 | 1 | 50 | 250 | 15 | 49.5 | Zn plating | 0 | ○ | B |
| | 2 | 0 | 30 | 255 | 16 | 49.5 | Zn plating | 0 | ○ | A |
| | 3 | 0 | 30 | 255 | 15 | 49.5 | Zn plating | 0 | ○ | A |
| | 4 | 0 | 20 | 260 | 15 | 49.5 | Electroless Ni—P plating | 0 | ○ | A |
| | 5 | 0 | 30 | 260 | 16 | 49.5 | Electroless Ni—P plating | 0 | ○ | A |
| | 6 | 1 | 20 | 280 | 12 | 43.0 | Electroless Ni—P plating | 1 | ○ | C |
| Comparative Example | 1 | ***25*** | 20 | 270 | ***3*** | 52.0 | Zn plating | ***8*** | X | ***D*** |
| | 2 | 1 | 30 | ***190*** | 16 | 48.0 | Electroless Ni—P plating | 0 | ○ | ***D*** |
| | 3 | ***20*** | 600 | 250 | 14 | 49.0 | Electroless Ni—P plating | ***6*** | X | ***D*** |
| | 4 | 0 | 550 | ***150*** | 19 | 49.5 | Zn plating | 0 | ○ | ***D*** |
| | 5 | 0 | 30 | ***190*** | 12 | 49.5 | Zn plating | 0 | ○ | ***D*** |

N.B. Numerical values in bold italic in the table are out of appropriate range of the present invention or characteristics are of rejectable level.

TABLE 4

| | Al Alloy wire rod Characteristics | | | Plated Al Alloy wire rod Characteristics | |
|---|---|---|---|---|---|
| Comprehensive evaluation | Tensile strength (MPs) | Elongation after fracture (%) | Conductivity (% IACS) | Presence proportion of pinholes on plating surface (pinhole(s)/mm$^2$) | Evaluation of platability |
| A | 260 or more | 10 or more | 45 or more | 0 | ○ |
| B | 250 or more | 10 or more | 45 or more | 1 or less | ○ |
| C | 200 or more | 5 or more | 40 or more | 1 or less | ○ |
| D | Of the above-described characteristics, at least one characteristic does not satisfy the pass evaluation standard C | | | | |

From the results shown in Table 3, the following are elucidated. Each of the aluminum alloy wires of Examples 1 to 6 had a tensile strength, an elongation after fracture and a conductivity, all being at pass level, is excellent in platability, and had a comprehensive evaluation was a pass level. In contrast, in each of the aluminum alloy wires of Comparative Examples 1 and 3, the presence ratio of the compound particles present on the wire rod surface and having a particle size of greater than or equal to 1 μm is out of the scope of the present disclosure. Accordingly, the presence ratio of the pinholes generated on the plated film surface in a case where a subsequent plating was performed increased, thus the platability was poor, and the comprehensive evaluation was "rejectable". In Comparative Example 2, the Fe content in the wire rod was too small. Consequently, the tensile strength was insufficient, and the comprehensive evaluation was "rejectable". Moreover, in each of Comparative Example 4 in which the heating temperature of the solution heat treatment was higher than the scope of the present disclosure, and Comparative Example 5 in which the heating temperature of the aging heat treatment was higher than the scope of the present disclosure, the tensile strength was insufficient and the comprehensive evaluation was "rejectable".

The aluminum alloy wire rod of the present disclosure is capable of having sufficient mechanical characteristics even when used in a small-diameter wire having a strand diameter of less than or equal to 0.5 mm, and is accordingly useful as a battery cable, a wire harness or a conducting wire for a motor, equipped on a transportation vehicle, and as a wiring structure of an industrial robot.

What is claimed is:

1. An aluminum alloy wire rod having a composition comprising Mg: 0.1 mass % to 1.0 mass %, Si: 0.1 mass % to 1.2 mass %, Fe: 0.10 mass % to 1.40 mass %, Ti: 0 mass % to 0.100 mass %, B: 0 mass % to 0.030 mass %, Cu: 0 mass % to 1.00 mass %, Ag: 0 mass % to 0.50 mass %, Au: 0 mass % to 0.50 mass %, Mn: 0 mass % to 1.00 mass %, Cr: 0 mass % to 1.00 mass %, Zr: 0 mass % to 0.50 mass %, Hf: 0 mass % to 0.50 mass %, V: 0 mass % to 0.50 mass %, Sc: 0 mass % to 0.50 mass %, Co: 0 mass % to 0.50 mass %, Ni: 0 mass % to 0.50 mass %, and the balance: Al and inevitable impurities, wherein a number of compound particles present on a surface and having a diameter of greater than or equal to 1 μm in terms of equivalent circle diameter is less than or equal to one per 100 $\mu m^2$, and a tensile strength is greater than or equal to 200 MPa.

2. The aluminum alloy wire rod according to claim 1, wherein the composition comprises both of or any one of Ti: 0.001 mass % to 0.100 mass % and B: 0.001 mass % to 0.030 mass %.

3. The aluminum alloy wire rod according to claim 1, wherein the composition comprises at least one of Cu: 0.01 mass % to 1.00 mass %, Ag: 0.01 mass % to 0.50 mass %, Au: 0.01 mass % to 0.50 mass %, Mn: 0.01 mass % to 1.00 mass %, Cr: 0.01 mass % to 1.00 mass %, Zr: 0.01 mass % to 0.50 mass %, Hf: 0.01 mass % to 0.50 mass %, V: 0.01 mass % to 0.50 mass %, Sc: 0.01 mass % to 0.50 mass %, Co: 0.01 mass % to 0.50 mass % and Ni: 0.01 mass % to 0.50 mass %.

4. The aluminum alloy wire rod according to claim 1, wherein a sum of contents of Fe, Ti, B, Cu, Ag, Au, Mn, Cr, Zr, Hf, V, Sc, Co and Ni is 0.10 mass % to 2.00 mass %.

5. The aluminum alloy wire rod according to claim 1, wherein the compound particles are Fe-based compound particles.

6. The aluminum alloy wire rod according to claim 1, wherein a thickness of a surface oxide layer is less than or equal to 500 nm.

7. The aluminum alloy wire rod according to claim 1, wherein the aluminum alloy wire rod has a plated film on a surface thereof, and a presence ratio of pinholes each having a diameter of greater than or equal to 1 μm in terms of equivalent circle diameter is less than or equal to one pinhole/$mm^2$.

8. The aluminum alloy wire rod according to claim 1, wherein the aluminum alloy wire rod is an aluminum alloy wire having a strand diameter of 0.1 mm to 0.5 mm.

9. An aluminum alloy stranded wire obtained by stranding a plurality of the aluminum alloy wires as claimed in claim 8.

10. A covered wire comprising a covering layer at an outer periphery of one of the aluminum alloy wire as claimed in claim 8.

11. The aluminum alloy wire rod according to claim 2, wherein the composition comprises at least one of Cu: 0.01 mass % to 1.00 mass %, Ag: 0.01 mass % to 0.50 mass %, Au: 0.01 mass % to 0.50 mass %, Mn: 0.01 mass % to 1.00 mass %, Cr: 0.01 mass % to 1.00 mass %, Zr: 0.01 mass % to 0.50 mass %, Hf: 0.01 mass % to 0.50 mass %, V: 0.01 mass % to 0.50 mass %, Sc: 0.01 mass % to 0.50 mass %, Co: 0.01 mass % to 0.50 mass % and Ni: 0.01 mass % to 0.50 mass %.

12. The aluminum alloy wire rod according to claim 2, wherein a sum of contents of Fe, Ti, B, Cu, Ag, Au, Mn, Cr, Zr, Hf, V, Sc, Co and Ni is 0.10 mass % to 2.00 mass %.

13. The aluminum alloy wire rod according to claim 3, wherein a sum of contents of Fe, Ti, B, Cu, Ag, Au, Mn, Cr, Zr, Hf, V, Sc, Co and Ni is 0.10 mass % to 2.00 mass %.

14. The aluminum alloy wire rod according to claim 2, wherein the compound particles are Fe-based compound particles.

15. The aluminum alloy wire rod according to claim 3, wherein the compound particles are Fe-based compound particles.

16. The aluminum alloy wire rod according to claim 4, wherein the compound particles are Fe-based compound particles.

17. The aluminum alloy wire rod according to claim 2, wherein a thickness of a surface oxide layer is less than or equal to 500 nm.

18. A wire harness comprising:

a covered wire including a covering layer at an outer periphery of one of an aluminum alloy wire rod and an aluminum alloy stranded wire; and a terminal fitted at an end portion of the covered wire, the covering layer being removed from the end portion, wherein the aluminum alloy wire rod had a composition comprising Mg: 0.1 mass % to 1.0 mass %, Si: 0.1 mass % to 1.2 mass %, Fe: 0.10 mass % to 1.40 mass %, Ti: 0 mass % to 0.100 mass %, B: 0 mass % to 0.030 mass %, Cu: 0 mass % to 1.00 mass %, Ag: 0 mass % to 0.50 mass %, Au: 0 mass % to 0.50 mass %, Mn: 0 mass % to 1.00 mass %, Cr: 0 mass % to 1.00 mass %, Zr: 0 mass % to 0.50 mass %, Hf: 0 mass % to 0.50 mass %, V: 0 mass % to 0.50 mass %, Sc: 0 mass % to 0.50 mass %, Co: 0 mass % to 0.50 mass %, Ni: 0 mass % to 0.50 mass %, and the balance: Al and inevitable impurities, wherein a number of compound particles present on a surface and having a diameter of greater than or equal to 1 μm in terms of equivalent circle diameter is less than or equal to one per 100 $\mu m^2$, and a tensile strength is greater than or equal to 200 MPa.

* * * * *